United States Patent [19]

Hsu et al.

[11] 4,427,540

[45] Jan. 24, 1984

[54] PRODUCTION OF ANODE GRADE PETROLEUM COKE

[75] Inventors: Harry L. Hsu, Johnson City; Lloyd I. Grindstaff, Elizabethton; Leslie H. Juel, Johnson City, all of Tenn.

[73] Assignee: Great Lakes Carbon Corporation, New York, N.Y.

[21] Appl. No.: 439,912

[22] Filed: Nov. 8, 1982

[51] Int. Cl.[3] ..... C10G 9/14; H01B 1/06; H01B 1/04

[52] U.S. Cl. ..... 208/131; 208/127; 252/509

[58] Field of Search ..... 208/131, 127; 252/509

[56] References Cited

U.S. PATENT DOCUMENTS

| | | | |
|---|---|---|---|
| 2,361,220 | 10/1944 | Loftis | 252/509 |
| 2,953,518 | 9/1960 | McKinley et al. | 208/127 |
| 3,174,872 | 3/1965 | Fisher et al. | 252/509 |
| 3,624,356 | 11/1971 | Havill | 252/509 |
| 4,096,097 | 6/1978 | Yan | 208/131 |

OTHER PUBLICATIONS

Guthrie, Petroleum Products Handbook, 1st Ed., McGraw-Hill Book Company, Inc., New York, 1960, pp. 10–11.

*Primary Examiner*—Delbert E. Gantz
*Assistant Examiner*—Chung K. Pak
*Attorney, Agent, or Firm*—R. Laddie Taylor

[57] ABSTRACT

The oxidation resistance of carbon bodies formed from petroleum coke is increased by inhibiting the catalytic effects of vanadium and/or nickel impurities in the coker feedstock through utilization of an effective amount of an inorganic magnesium compound or an organo-magnesium compound present in such feedstock during coking.

10 Claims, No Drawings

PRODUCTION OF ANODE GRADE PETROLEUM COKE

BACKGROUND OF THE INVENTION

The invention relates to a process for the production of petroleum coke suitable for use in the manufacture of carbon anodes employed in Hall-Heroult cells for aluminum manufacture.

Petroleum coke is the residue resulting from the thermal decomposition or pyrolysis of high boiling hydrocarbons at temperatures in the range of about 350° C. to 500° C. High boiling virgin or cracked petroleum residues are typical charging stocks for the production of anode grade coke, the process often being carried out as an integral part of the overall petroleum refinery operation. Industrial petroleum coke is manufactured by methods well known in the art, the major source being the delayed coking process. Other conventional coking methods known in the art include fluid coking and moving bed coking.

Aluminum is conventionally produced in Hall-Heroult cells by the electrolysis of alumina in molten cryolite. The cell is typically a shallow vessel, with a carbon floor forming the cathode, the side walls comprising a rammed coal-pitch or coke-pitch mixture, and the anode consisting of a carbonaceous block suspended in the molten cryolite bath at an anode-cathode separation distance of a few centimeters. The anode is typically formed from a pitch-calcined petroleum coke blend, prebaked to form a monolithic block of amorphous carbon. The cathode is conventionally formed from a pre-baked blend of pitch and calcined anthracite or coke, with cast-in-place iron over steel bar electrical conductors in grooves in the bottom of the cathode.

One of the major requirements of calcined petroleum coke used in the production of carbon anodes is low metallic impurities. The availability of good quality feedstocks for the production of anode grade coke is rapidly diminishing, resulting in increased usage of lower grade crude oils. Increases in the metallic impurities content of the cokes produced from such crude oils can thus be expected because the impurities concentrate in the coke during coking operations.

High levels of metallic impurities, particularly vanadium and nickel, in cokes adversely affect the performance of anodes formed from the cokes. Both the vanadium and nickel in the coke catalyze oxidation of the anode surface exposed to the atmosphere during high temperature cell operation, resulting in air-burning associated with corrosive effects on aluminum cell exhaust duct work. Although some aluminum producers attempt to protect the exposed anode surface by coating with aluminum or burying with alumina after positioning of the anode in the cell, some air-burning still occurs.

The oxidation of petroleum coke by reaction with air at high temperature may be measured in the laboratory by a procedure known in the art as air reactivity.

SUMMARY OF THE INVENTION

Our invention involves a process for producing petroleum coke suitable for use in the manufacture of carbon anodes for aluminum production from a petroleum feedstock containing high levels of vanadium and/or nickel impurities, comprising coking said feedstock in the presence of a magnesium compound selected from the group consisting of inorganic magnesium compounds and oil soluble organo-magnesium compounds, preferably in an amount in the range of about 0.001 to 0.1 wt. % calculated as Mg, based on the weight of the feedstock. Carbon anodes formed from the resulting coke exhibit improved resistance to oxidation usually caused by the catalytic effects of the vanadium and nickel impurities present in the coke.

For the purpose of this invention, "high levels of vanadium and/or nickel impurities" in coker feedstock is defined as a vanadium content of at least 0.02 wt. % and/or a nickel content of 0.02 wt. %, based on the weight of the coke produced from the feedstock.

The magnesium compound may be an inorganic compound, in which case it is preferably in finely divided form (e.g., ≦44 microns). Further, it has been discovered that an amount of a finely divided inorganic magnesium in the range of 0.002 to 0.010 wt. % calculated as Mg, based on the weight of the feedstock, is particularly effective to provide inhibition of the catalytic effects of vanadium and nickel when added to the feedstock in the form of a predispersed liquid concentrate, the dispersion being made in a liquid medium compatible with the feedstock, such as a portion of the feedstock itself.

Examples of inorganic magnesium compounds effective in the process of our invention include MgO, $MgCO_3$, $Mg(OH)_2$, $Mg(C_2H_3O_2)_2$, $MgCO_3.Mg(OH)_2$, $MgSO_4$ and $MgCl_2$. The preferred compound is MgO.

Alternately, the magnesium compound may be an oil soluble organo-magnesium compound, examples of which are KONTROL® KI-16 and KI-81, available from the Tretolite Division of Petrolite Corp. The products are oil soluble, liquid organo-magnesium compounds comprised of magnesium salts of an organic acid in a solvent. KI-16 contains 8% Mg and KI-81 contains 15% Mg.

As stated above, the air reactivity value of a petroleum coke is a measure of the oxidation resistance of the coke and may be determined as follows. The coke sample is first crushed to particles having a size such thay they will pass through a 20 mesh (Tyler scale) screen but will be retained on a 10 mesh screen. Ten grams of the sample are then placed in a crucible and suspended in a vertical combustion chamber heated to 510° C., the chamber having a downward air flow of 30 liters per hour. After 4.5 hours reaction time has elapsed, the oxidation loss of the sample is determined. The air reactivity of the coke sample is expressed as the % weight loss.

DESCRIPTION OF THE PREFERRED EMBODIMENTS

The invention will now be described in the following non-limiting examples.

EXAMPLE I

Laboratory coking runs were carried out utilizing a coker feedstock conventionally employed in the production of regular sponge coke used for the fabrication of anodes for aluminum production. This feedstock had relatively high vanadium and nickel contents of about 530 ppm and 420 ppm respectively, calculated on a coke product basis.

An additive consisting of selected amounts of finely divided MgO were added to four samples of the feedstock, the samples being designated B, C, D and E, by dispersing the weighed MgO in a small amount of the feedstock for about 5 minutes using a high speed blender. The mixture was then thoroughly mixed with the sample to be coked. The samples, along with a control designated A, were individually coked in an insulated glass resin flask. An inert gas was bubbled up from the bottom of the coking pot at a rate of about 4.5 liters/hr/kg feedstock to keep the MgO uniformly dispersed in the feedstock. The following time-temperature cycle was used:

| Temperature | Elapsed Time | Rate ΔC°/hr |
|---|---|---|
| Room-350° C. | 3 hours | 110 |
| 350-425° C. | 3.75 hours | 20 |
| 425° C. | 15 hours | — |

The raw cokes produced were calcined using conventional laboratory procedures at about 1300° C. for about 0.5 hours and air reactivity values were determined for each sample using the procedure described above. The results are shown in the Table below.

EXAMPLE II

Laboratory coking runs were carried out utilizing the same feedstock employed in Example I. Selected amounts of KONTROL ® KI-81 were added to four samples of the feedstock, designated AA, BB, CC and DD, by adding a calculated amount into each feedstock followed by stirring to uniformity. Since KONTROL ® KI-81 was completely miscible with the petroleum feedstock, no predispersion, such as was used in Example I, was required. The samples of feedstock were coked using the procedure described above, except that no agitation by gas bubbling was required.

The coke samples were then calcined at about 1300° C. for about 0.5 hours and air reactivity values were determined for the resulting calcined coke. The results are also shown in the Table.

TABLE

| Coking Run | Magnesium Compound Added To Feedstock | Wt. % Mg | Air Reactivity |
|---|---|---|---|
| A | Control | 0 | 44.0 |
| B | MgO | 0.002 | 12.3 |
| C | MgO | 0.005 | 8.6 |
| D | MgO | 0.007 | 5.2 |
| E | MgO | 0.012 | 7.1 |
| AA | KI-81 | 0.003 | 8.7 |
| BB | KI-81 | 0.006 | 4.0 |
| CC | KI-81 | 0.012 | 4.6 |
| DD | KI-81 | 0.018 | 3.8 |

It is evident from the data that utilization of inorganic magnesium compounds and oil soluble organo-magnesium compounds as additives for coker feedstocks result in a product coke of increased oxidation resistance by inhibiting the catalytic effects of the vanadium and nickel impurities.

While the invention has been described in detail and with reference to specific embodiments thereof, it will be apparent to one skilled in the art that various changes and modifications can be made therein without departing from the scope and spirit thereof, and, therefore, the invention is not intended to be limited except as indicated in the appended claims.

We claim:

1. A process for producing petroleum coke suitable for use in the manufacture of carbon anodes for aluminum production from a petroleum feedstock containing high levels of vanadium and/or nickel impurities, comprising coking said feedstock in the presence of a magnesium compound selected from the group consisting of inorganic magnesium compounds and oil soluble organo-magnesium compounds in an amount in the range of about 0.001 to 0.1 wt. % calculated as Mg, based on the weight of the feedstock, thereby increasing the oxidation resistance of carbon bodies formed from said coke by inhibiting the catalytic effects of the vanadium and nickel impurities contained in the coke.

2. The process of claim 1 wherein the magnesium compound is an inorganic magnesium compound in finely divided form.

3. The process of claim 2 wherein from 0.002 to 0.010 wt. % of the inorganic magnesium compound calculated as Mg, based on the weight of the petroleum feedstock, is added to said feedstock in the form of a predispersed liquid concentrate of said inorganic magnesium compound disposed in a liquid medium compatible with said feedstock.

4. The process of claim 3 wherein the organic magnesium compound is dispersed in a portion of the petroleum feedstock.

5. The process of claims 2, 3, or 4 wherein the inorganic magnesium compound is MgO.

6. The process of claim 1 wherein the magnesium compound is an oil soluble organo-magnesium compound.

7. The process of claim 6 wherein the organo-magnesium compound is a magnesium salt of a polyaromatic acid in an aromatic solvent.

8. The process of claim 7 wherein the concentration of the magnesium of the magnesium salt is 15 wt. % in the aromatic solvent.

9. The process of claim 8 wherein from 0.02 to 0.12 wt. % of the magnesium salt/solvent mixture, based on the weight of the petroleum feedstock, is added to said feedstock.

10. A process for producing petroleum coke suitable for use in the manufacture of carbon anodes for aluminum production from a petroleum feedstock containing high levels of vanadium and/or nickel impurities, comprising coking said feedstock in the presence of a magnesium compound selected from the group consisting of inorganic magnesium compounds and oil soluble organo-magnesium compounds in an amount sufficient to effectively increase the oxidation resistance of carbon bodies formed from said coke by inhibiting the catalytic effects of the vanadium and nickel impurities contained in the coke.

* * * * *